US007987961B2

(12) United States Patent
Bell et al.

(10) Patent No.: US 7,987,961 B2
(45) Date of Patent: Aug. 2, 2011

(54) COIN DISPENSING APPARATUS

(75) Inventors: Malcolm Reginald Hallas Bell, Leeds (GB); Phil Richardson, Ashton-u-Lyne (GB); Peter Crossan, Oldham (GB); David F Ellwood, Cheshire (GB)

(73) Assignee: Money Controls Limited, Royton Oldham (GB)

( * ) Notice: Subject to any disclaimer, the term of this patent is extended or adjusted under 35 U.S.C. 154(b) by 395 days.

(21) Appl. No.: 12/089,701

(22) PCT Filed: Oct. 13, 2006

(86) PCT No.: PCT/EP2006/067403

§ 371 (c)(1),
(2), (4) Date: Jul. 8, 2008

(87) PCT Pub. No.: WO2007/042575

PCT Pub. Date: Apr. 19, 2007

(65) Prior Publication Data

US 2009/0135426 A1 May 28, 2009

(30) Foreign Application Priority Data

Oct. 14, 2005 (GB) ..... 0520970.5

(51) Int. Cl.
*G07F 5/02* (2006.01)

(52) U.S. Cl. ..... 194/346; 194/317; 194/334; 194/343

(58) Field of Classification Search ..... 356/71, 356/237.1–237.5; 194/328–334, 317, 346, 194/343

See application file for complete search history.

(56) References Cited

U.S. PATENT DOCUMENTS 4,413,718 A * 11/1983 Dean ..... 194/344
4,588,292 A * 5/1986 Collins ..... 356/71
5,515,960 A * 5/1996 Wood ..... 194/328
6,044,952 A 4/2000 Haggerty et al.

(Continued)

FOREIGN PATENT DOCUMENTS

DE 37 11 941 A1 10/1988

(Continued)

OTHER PUBLICATIONS

Written PCT Search Report for PCT/EP2006/067403 dated Apr. 24, 2008.

(Continued)

*Primary Examiner* — Hoa Q Pham
(74) *Attorney, Agent, or Firm* — Orrick Herrington & Sutcliffe, LLP

(57) ABSTRACT

A coin dispensing apparatus, which ejects coins by squeezing them substantially chordally between an element on a rotor and an ejector, has a variable height rotor (3), an improved two-part coin ejector (10*a*, 10*b*). A optical sensor for detecting coins being ejected positive detects both the presence and absence of coins in a coin path. Also, a payout device comprising a first coin dispensing device (61) including a dispensed coin type detector and a second coin dispensing device (62). The first coin dispensing device (61) is used to store coins of plurality of large denominations and is used initially for paying out an amount. The second coin dispensing device (62) is used for a single low denomination coin type and coins are dispensed from the second coin dispensing device (62) after the first coin dispensing device has been used as much as possible.

18 Claims, 13 Drawing Sheets

U.S. PATENT DOCUMENTS

| | | | | |
|---|---|---|---|---|
| 6,774,986 | B2 * | 8/2004 | Laskowski | 356/71 |
| 7,185,750 | B2 * | 3/2007 | Sugata et al. | 194/328 |
| 2005/0139448 | A1 * | 6/2005 | Griese | 194/346 |
| 2005/0224314 | A1 * | 10/2005 | Okada et al. | 194/230 |

FOREIGN PATENT DOCUMENTS

| | | | |
|---|---|---|---|
| EP | 0959437 | A2 | 11/1999 |
| EP | 1557798 | A2 | 7/2005 |
| EP | 1612744 | A2 | 1/2006 |
| GB | 2 212 313 | A | 7/1989 |
| GB | 2 266 176 | A | 10/1993 |
| GB | 2353129 | A | 2/2001 |
| WO | WO 99/60532 | | 11/1999 |
| WO | WO 2004/114228 | | 12/2004 |

OTHER PUBLICATIONS

Extended European Search Report dated Jun. 7, 2010.

* cited by examiner

COIN DISPENSING APPARATUS

FIELD OF THE INVENTION

The present invention relates to coin and/or token dispensing apparatus.

BACKGROUND

In the following, the term "coin" will be used to mean coins, tokens or the like.

The Compact Hopper™ made by Money Controls Limited of New Coin Street, Royton, Oldham, UK is well-known to those skilled in the art. The Compact Hopper™ dispenses coins using a rotor and a pair of sprung fingers. The rotor has a plurality of apertures in which coins collect and as the rotor rotates, coins ate dispensed from the bottoms of the apertures by the action of the sprung fingers. Rotors with different sized apertures are used for dispensing different sized coins.

In the Compact Hopper™, the rotor is installed in a rotor seat. The rotor is formed so that, when installed in the rotor seat, its base is spaced apart from the upper surface of the rotor seat by a distance that is sufficient to allow coins of a particular thickness to be dispensed from the bottoms of the apertures. Thus, there is the problem that, different rotors are required for dispensing coins of different thicknesses, which increases manufacturing costs.

SUMMARY OF THE INVENTION

According to the present invention, there is provided a coin dispensing apparatus which ejects coins by squeezing them substantially chordally between first and second elements, the second element being carried on the underside of a rotor which rotates, over a surface, with central shaft means, wherein the rotor can be mounted to the shaft means in a plurality of configurations to set the distance between the rotor and said surface differently.

The rotor may have an axially extending through hole by which coins can move through the rotor to said surface for ejection by said elements. There may be one, two, three, four or more such through holes according to the size of the rotor and the size of coin to be dispensed.

The rotor may have a central hole for receiving an end of the shaft means and the distance the shaft means can be inserted into the central hole be dependent on the angular position, about the operational axis of rotation of the rotor, of the shaft means relative to the rotor. Alternatively, there could be a pattern of small holes arranged around the axis of the rotor to receive pins on the shaft means. Some of the holes may be shallower than others so that the height of the rotor over the surface will depend on the relative angular positions of the rotor and the shaft means. Preferably, however, the cross-section of an axially inner portion of the hole in the rotor matches the cross-section of said end of the shaft means and the cross-section of an axially outer portion of said hole comprises a figure formed by combining the cross-section of the said end of the shaft means at a plurality of angular positions. Conveniently, the cross-section of said end of the shaft means is square and the cross-section of the axially outer portion of the hole in the rotor is a regular eight-pointed star. The shaft could have a tongue which is received in a hole having a cross-shaped cross-section outer part. Also, the cross-section of the shaft means could be triangular with the cross-section of the outer part of the hole being a six-pointed star.

According to the present invention, there is further provided a rotor for rotating over a surface of a coin dispensing apparatus such that coins can pass between the surface and a portion of the rotor, the rotor comprising means for mounting the rotor to a central shaft means of the coin dispensing apparatus in a plurality of configurations, each configuration setting a different distance between the portion and the surface.

The Compact Hopper™ has been improved on, by the present invention, in respect of the dispensing of small coins. Such coins are not of sufficient diameter to engage with both of the sprung fingers when they are dispensed. Accordingly, the force imparted to such coins when they are dispensed is reduced.

According to the present invention, there is provided a coin dispensing apparatus which ejects coins by squeezing them substantially chordally between first and second elements, the second element being carried on the underside of a rotor, which rotates over a surface, and the first element comprising a first, radially inner ejector and a second, radially outer ejector, wherein the ejectors are configured such that the first ejector can move in a coin ejecting direction without the second ejector also moving in its coin ejecting direction.

The first ejector preferably includes a member that bears against the second ejector such that the second ejector is pushed by said member when the first ejector is moved by a coin being driven by the second element.

Preferably, the first ejector comprises a body having a coin engaging projection, projecting through said surface, and an arm on one side and the second ejector comprises a body having a coin engaging projection, projecting through said surface, and an arm on one side, the arm of the first ejector bearing against the arm of the second ejector, wherein the arm of the second ejector is pushed by the arm of the first ejector when the first ejector is moved by a coin being driven by the second element.

Preferably, the first and second ejectors are connected to respective spring means for storing energy for coin ejection when they are being moved by a coin being driven by the second element.

A known coin sensor, for detecting the passage of coins, comprises a light emitting device disposed on one side of the output port and a light detecting device disposed at a corresponding position on the opposite side of the output port. Thus, when a coin is dispensed through the output port, the coin cuts the beam of light travelling between the emitter and the detector. The detector may then output a low signal, indicating that a coin has been detected. There is a problem however, in that a fraudster may attempt to blind the detector with light in order to prevent the low signal from being output when a coin passes through the output port.

Another known coin sensor comprises a light emitting device and a light detector disposed at spaced apart locations on the same side of the output port. With this configuration, when no coin is present in the output port, the detector outputs a low signal. When a coin is dispensed, the beam from the light emitter reflects off the surface of the coin and is directed to the detector. Thus, the detector outputs a high signal to indicate that a coin has been dispensed. A problem with this configuration of coin sensor, however, is that a fraudster may slide a cover over the detector, such that it always outputs a low signal.

According to the present invention, there is provided an optical sensor for detecting the passage of a coin comprising first detection means for producing and detecting a first beam crossing a coin path in the absence of a coin, and second detection means for producing and detecting a second beam reflected from a coin in said coin path.

The first and second detection means may share a light source and employ respective optical detectors. A light source prism may be arranged such that some light from the light source enters the light source prism and is directed thereby obliquely across the coin path, for use in the second detection means, and some light from the light source passes by the light source prism and passes substantially perpendicularly across the coin path, for use in the first detection means. A light detector prism may be configured to receive light from the light source prism, that has subsequently been reflected by a coin the coin path, and redirect the received light substantially perpendicular to the light path onto the optical detector of the second detection means. A trapezoidal prism may be provided for returning light, which by-passes the light source prism, back across the coin path to the optical detector of the first detection means.

An embodiment includes a member through which the coin path passes, wherein the member comprises a first prism partially aligned with a light source for redirecting some light from the light source obliquely into the coin path, a second prism for capturing light from the first prism and reflected from a coin in the coin path and redirecting the captured light onto a first light detector, and a third prism for returning light from the light source, which has not been redirected by the first prism, back across the coin path to a second light detector. The light source and the light detectors are preferably mounted to the member such that the light source is between the light detectors.

The optical sensor may further comprise processing means operable to receive a detection indicating signal from each of the first and second detection means. The processing means may be further operable to provide an output signal, in response to the detection indicating signals, indicative of the detection of the passage of a coin.

The first and/or second beams can be pulsed beams. This can provide a further level of security against fraudulent attacks, for instance those attacks in which a fraudster attempts to blind detectors with light.

Mixed-coin discriminating re-circulating coin dispensing apparatuses are known in the art. When such apparatuses are used to dispense a sum of money, a first coin is dispensed and the value of the coin is determined. If the value of the first coin exceeds the sum to be dispensed, then the coin is re-circulated into the hopper and another coin is dispensed. If the value of the first coin does not exceed the sum to be dispensed then a second coin is dispensed. This process continues until the desired sum of money has been dispensed.

A problem with such apparatuses is that they can take a long time to dispense a sum of money. For example, consider an apparatus which dispenses €1, €2 and €0.5 coins. If such an apparatus is required to dispense a sum of €12.50, then if €12 are dispensed the correct sum of money can only be dispensed in the event that the next coin is a €0.5 coin. The probability that such a coin will be dispensed may be substantially less than the probability of one of the other types of coin in the hopper from being dispensed and, accordingly it will take a time for the correct sum of money to be dispensed.

According to the present invention, there is provided a payout device comprising:

a first coin dispensing device including a dispensed coin type detector;

a second coin dispensing device; and a controller, wherein the controller is configured to respond to a payout instruction and a payout value by:

calculating a threshold by subtracting a stored value representing the value of the highest denomination coin type for which the first coin dispensing device is used from a payout value;

causing the first coin dispensing device to dispense coins until the paid out amount is not less than the threshold, the controller determining the value of a paid out coin from the output of the dispensed coin type detector; and then causing the second coin dispensing device to dispense coins until the paid out amount equals said payout value.

BRIEF DESCRIPTION OF THE DRAWINGS

Embodiments of the present invention will now be described, by way of example, with reference to the accompanying drawings, in which.

DETAILED DESCRIPTION

Figure 1:
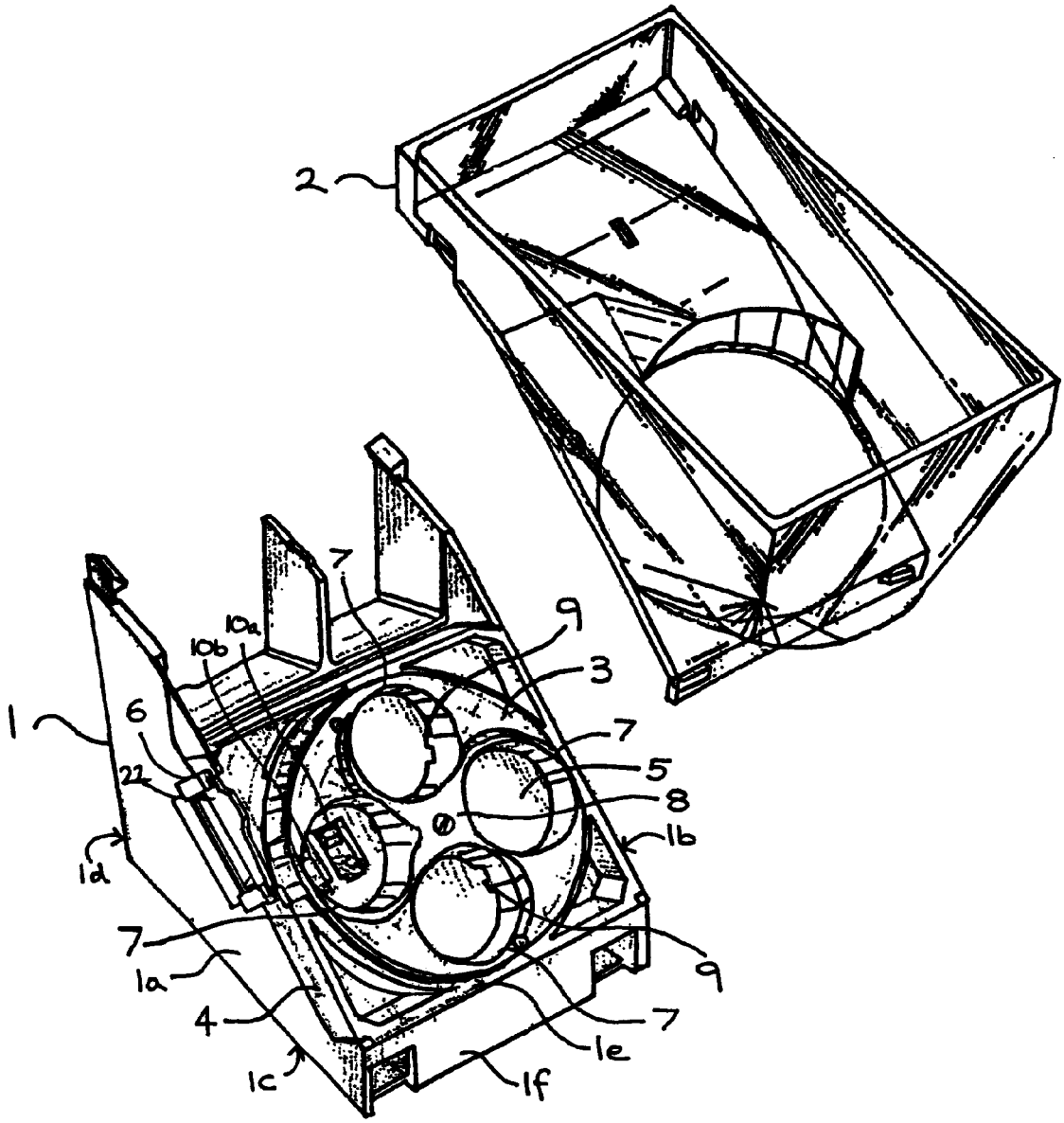
FIG. 1 is a perspective view of a coin dispensing apparatus according to the present invention.

Referring to FIG. 1, a coin dispensing apparatus, according to the present invention, comprises a body 1 and a hopper 2 releasably clipped to the body 1.

The body 1 has a generally triangular cross-section with two generally triangular side faces 1*a*, 1*b* and rectangular bottom and back faces 1*c*, 1*d*. The side, bottom and back faces 1*a*, 1*b*, 1*c*, 1*d* need not be solid.

The front face 1*e* of the body slopes save for a short vertical portion 1*f* at the very front. A rotor 3 is rotatably located in a rotor seat 4 in the sloping front face 1*e* of the body 1. A motor and transmission (not shown) are mounted behind the rotor seat 4. The rotor seat 4 may be removable as a unit with the motor and transmission. The rotor seat 4 in this example is approximately 85 mm square. However, the generally preferred range is 50-120 mm square.

The hopper 2 is conventional and is open at the top with sides that extend upwards from the tops of the sides of the body 1. The underside of the hopper 2 conforms generally to the front face 1*e* of the body 1 and has a hole opening onto the rotor 3. A hopper having a wider upper part may be used to increase the capacity of the apparatus.

The rotor seat 4 is square, when viewed along the axis of the rotor 3. A generally circular hollow 5 is formed in the rotor seat 4. A coin output port 6, through which coins are ejected, is formed in one side of the hollow 5. The coin output port 6 is provided with a coin sensor 22 for detecting the passage of a coin through the output port 6.

The rotor 3 comprises a plurality of circular apertures 7 disposed equidistantly around a central connecting screw 8. When the rotor 3 is rotated, by means of the motor and transmission, the apertures 7 progress along a circular path above the floor of the hollow 5.

The rotor 3 is installed in the rotor seat 4 such that the bottoms of the apertures 7 are spaced apart from the floor of the hollow 5 by a distance sufficient for a coin of a particular thickness to pass underneath the rotor 3.

A coin engaging part 9 extends from the bottom of each aperture 7 towards the floor of the hollow 5. When a coin falls into one of the apertures 7, the coin engaging part 9 pushes the coin along the annular path across the floor of the hollow 5.

A pair of sprung fingers 10*a*, 10*b* project through the floor of the hollow 5 radially in from the lower edge of the coin output port 6. The first sprung finger 10*a* is disposed radially inward of a second sprung finger 10*b*.

Figure 2:
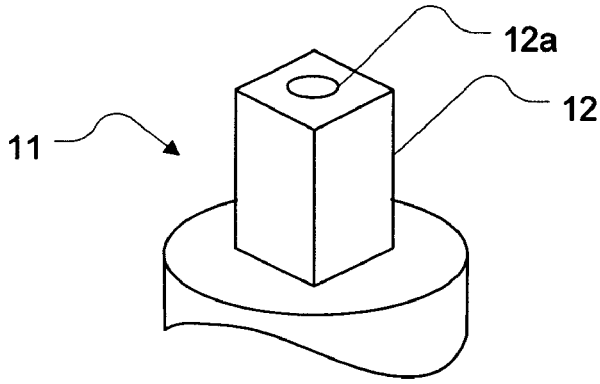
FIG. 2 shows the upper end of a shaft for driving the rotor of FIG. 1.

Referring to FIG. 2, a shaft 11 for driving the rotor 3 comprises an upper end 12 having a square cross-section and a threaded hole 12*a* for receiving the central connecting screw 8. The shaft is arranged such that it is coaxial with the circular hollow 5 and the upper end 12 projects through the floor of the hollow 5 to engage with the rotor 3.

Figure 3:
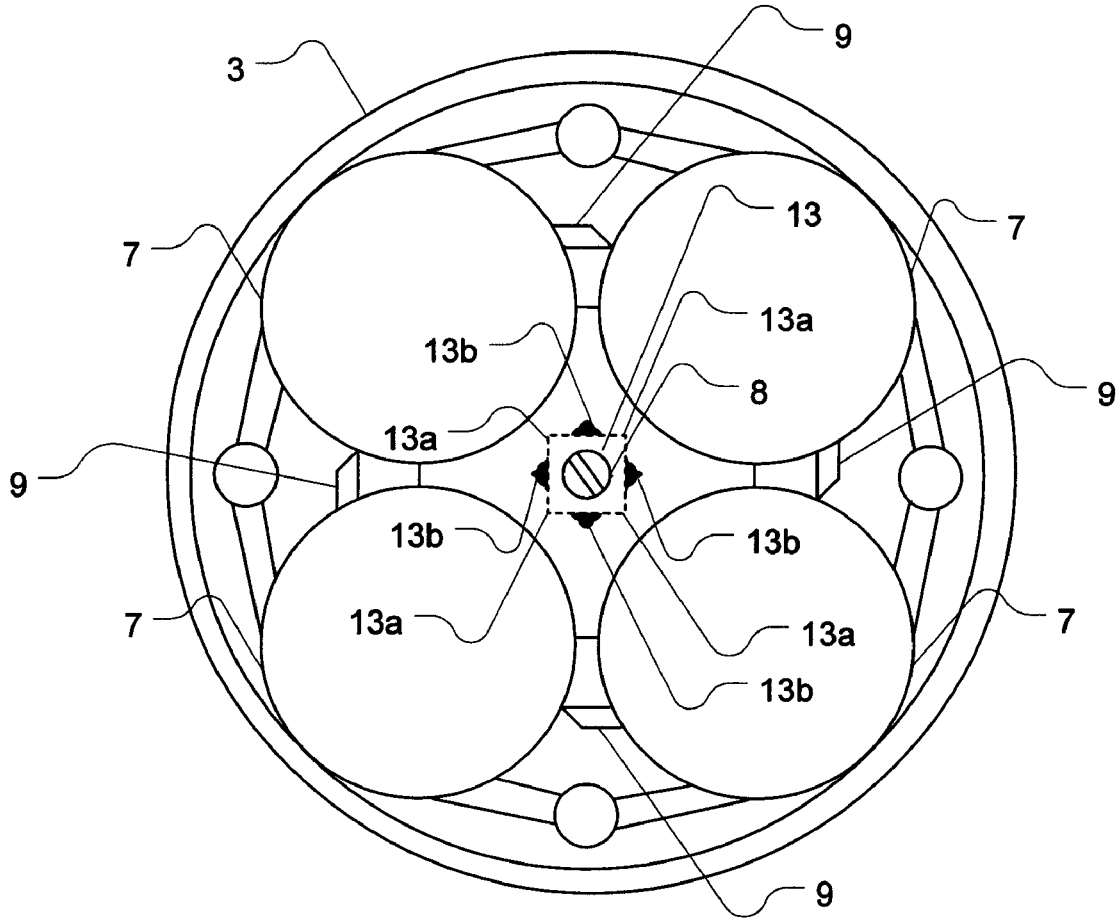
FIG. 3 shows the underside of the rotor of the coin dispensing apparatus of FIG. 1.

Referring to FIG. 3, at the centre of the rotor 3, there is a hole 13 for receiving the upper end 12 of the shaft 11. The hole 13 extends from an under side of the rotor 3 towards an upper surface of the rotor 3 and has a regular eight-pointed star cross-section at its opening. Accordingly, the upper end 12 of the shaft 11 may be fitted into the hole 13 in one of two orientations. More specifically, in a first orientation, the square cross-section of the upper end 12 is in register with a first set of four points 13*a* of the star and, in a second orientation, the square cross-section of the upper end 12 is in register with a second set of four points 13*b* of the star.

The central connecting screw 8 has a screw head in association with the upper surface of the rotor 3 and a body that extends down through the rotor 3 and into the threaded hole 12*a* of the upper end 12 of the shaft 11 so as to connect the rotor 3 to the shaft 11.

The first and second orientations in which the upper end 12 of the shaft 11 fits into the hole 13 will now be described in more detail with reference to FIGS. 4*a* and 4*b*.

Figure 4A:
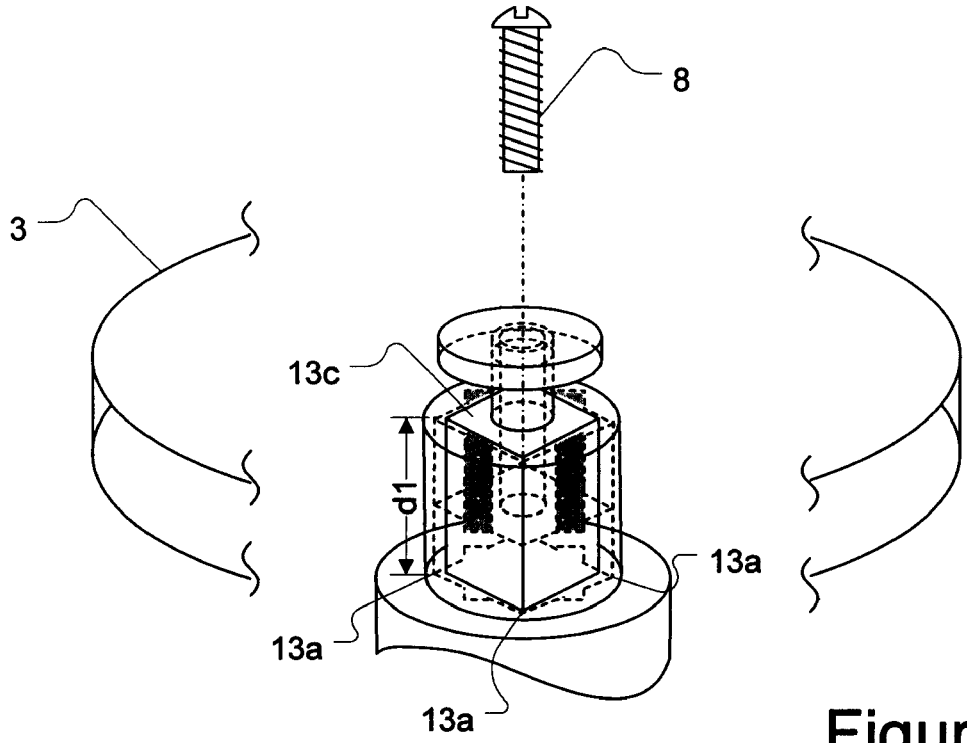
FIG. 4*a* shows the rotor of FIG. 2 attached to the shaft of FIG. 3 in a first orientation in which the coin dispensing apparatus is configured to dispense thin coins.

Referring first to FIG. 4*a*, in the first orientation, the square cross-section of the upper end 12 is in register with the first set of four points 13*a* of the star. In this orientation, the upper end 12 of the shaft 11 extends a depth d1 into the hole 13 and rests on a surface 13*c* forming the roof of the hole 13.

Figure 4B:
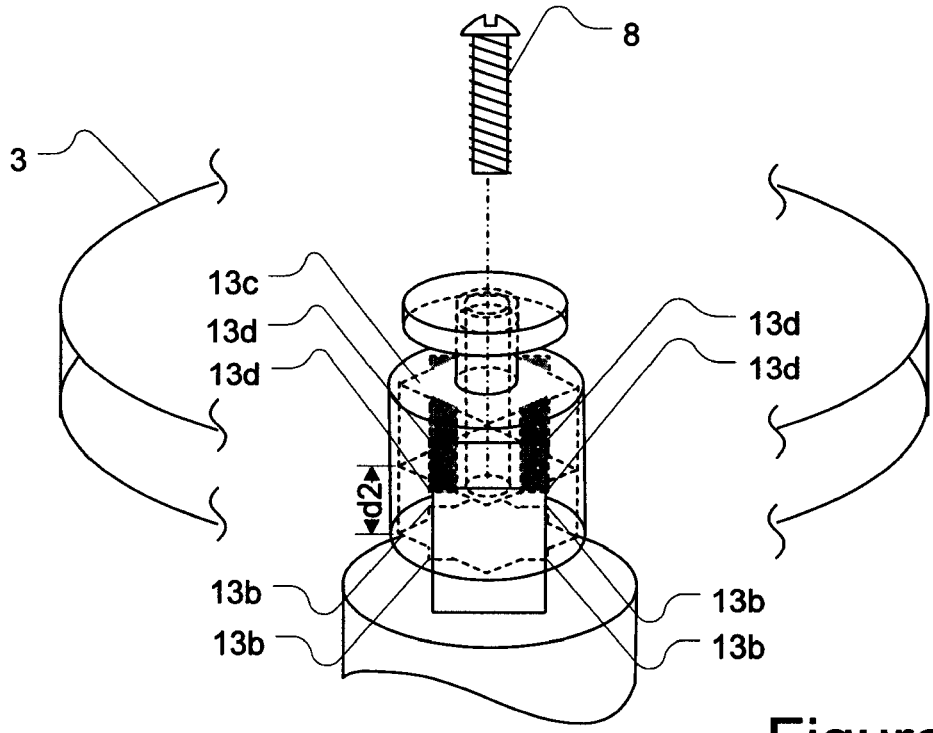
FIG. 4*b* shows the rotor of FIG. 2 attached to the shaft of FIG. 3 in a second orientation in which the coin dispensing apparatus is configured to dispense thicker coins.

Referring to FIG. 4*b*, in the second orientation, the square cross-section of the upper end 12 is in register with the second set of four corners 13*b* of the star. In this orientation, the upper end 12 of the shaft 11 extends a depth d2, where d2<d1, into the hole and rests against a plurality of triangular ledges 13*d* formed in the triangular cross-section channels defined by the four corners 13*b*.

Figure 5A:
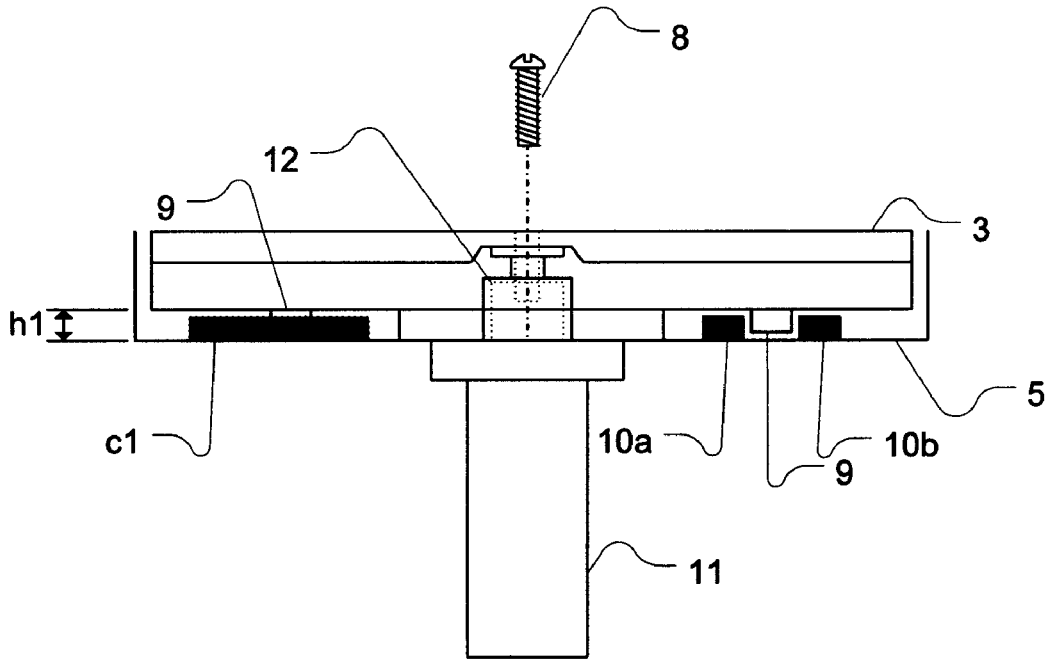
FIG. 5*a* shows the rotor installed in the rotor seat according to the configuration of FIG. 4*a;*

Referring to FIG. 5*a*, when the rotor 3 is installed on the shaft 11 in the first orientation, the base of the rotor 3 is spaced from the floor of the hollow 5 by a distance h1. In this configuration, a coin c1, which has a thickness less than h1, can be dispensed using the coin dispensing apparatus.

Figure 5B:
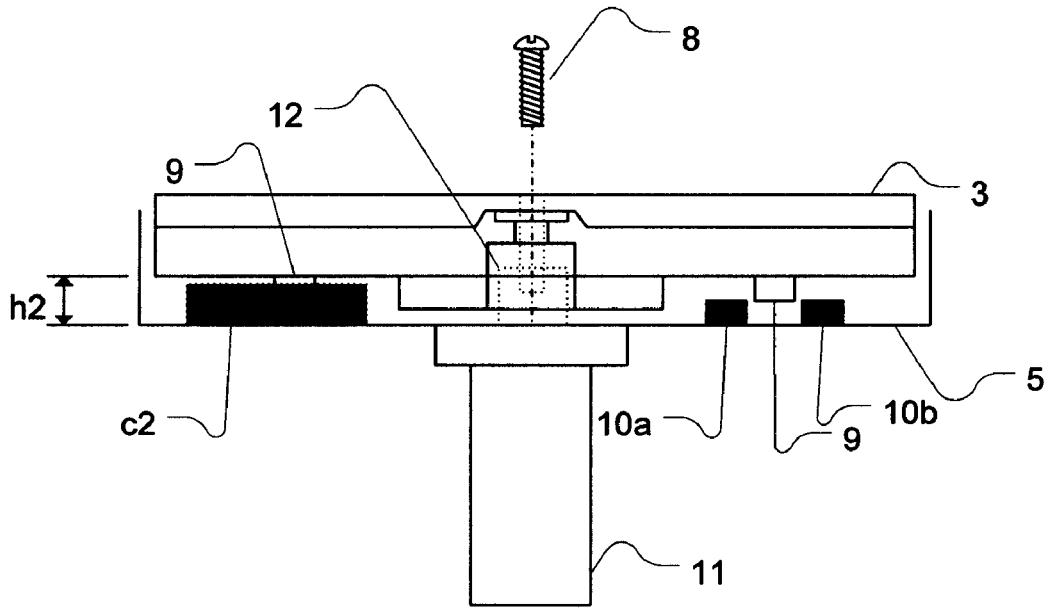
FIG. 5*b* shows the rotor installed in the rotor seat according to the configuration of FIG. 4*b;*

Referring to FIG. 5*b*, when the rotor 3 is installed on the shaft 11 in the second orientation, the base of the rotor 3 is spaced from the floor of the hollow 5 by a distance h2, where h2 is greater than h1 by an amount equal to d1−d2. In this configuration, a coin c2, which has a thickness less than h2 but greater than h1, can be dispensed using the coin dispensing apparatus.

Thus, a coin dispensing apparatus wherein the same rotor can be used for dispensing coins having different thicknesses is provided.

Figure 6:
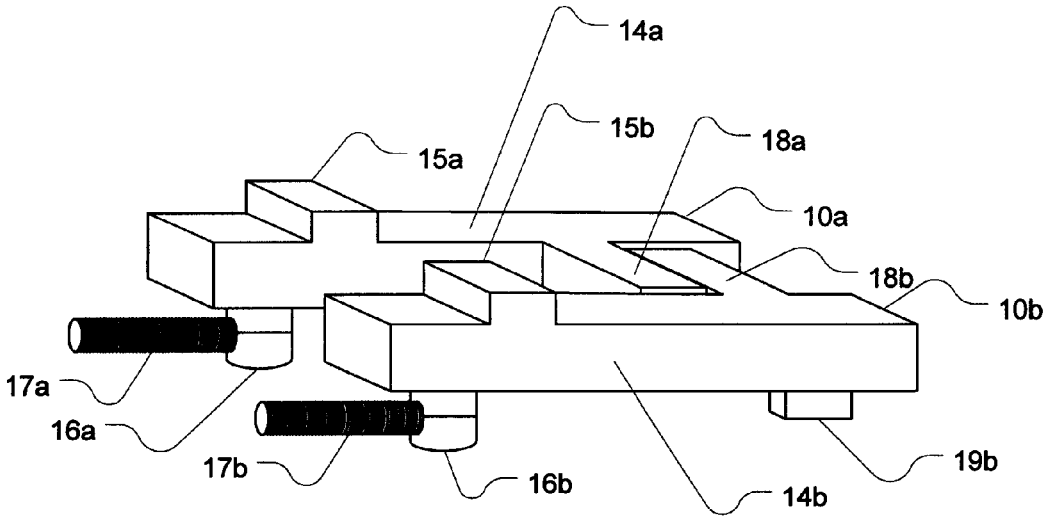
FIG. 6 shows a pair of sprung fingers for dispensing coins in the apparatus of FIG. 1.
Figure 7:
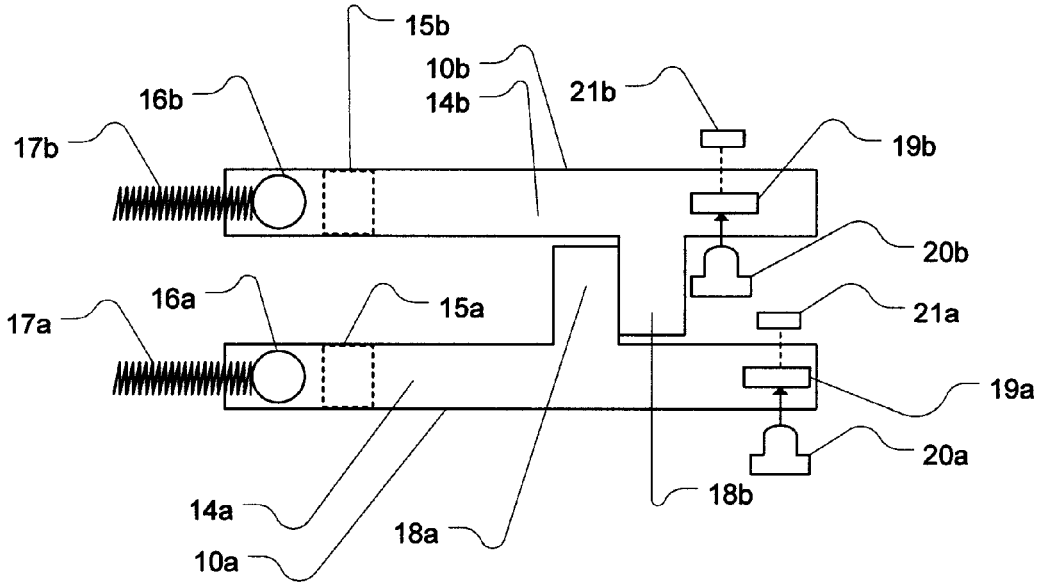
FIG. 7 shows the sprung fingers of FIG. 6 viewed from underneath.

Referring to FIGS. 6 and 7, the first sprung finger 10*a* comprises an elongate body 14*a*. A coin pushing part 15*a*, disposed towards the front end of the body, projects upward from the elongate body 14*a*. The body 14*a* of the first finger 10*a* is installed below a slot in the floor of the hollow 5, such that the coin pushing part 15*a* projects through the slot and above the floor of the hollow 5.

The elongate body 14*a* also has a spring coupling part 16*a* disposed at its front end. The spring coupling part 16*a* has a circular cross-section and projects downward from the lower surface of the elongate body 14*a*. One end of a tension spring 17*a* is anchored to the spring coupling part 16*a*.

A finger engaging part 18*a* is disposed towards the rear of the elongate body 14*a*. The finger engaging part 18*a* has a rectangular cross-section and extends towards the second sprung finger 10*b* at right angles to the axis of the elongate body 14*a*.

The first sprung finger 10*a* further includes a tab 19*a* at its rear, projecting downwardly from the lower surface of the elongate body 14*a*. An optical emitter 20*a* and an optical detector 21*a* are disposed on opposite sides of the tab 19*a*. Thus, movement of the first sprung finger 10*a* is detected by means of the signal output from the optical detector 21*a*. The detector 21*a* outputs a low signal when the coin pushing part 15*a* is not in contact with a coin and the tab 19*a* blocks the light emitted by the optical emitter 20*a*. Alternatively, the detector 21*a* may output a high signal when the coin pushing part 15*a* is in contact with a coin and the tension spring 17*a* is extended, moving the tab 19*a* out of the path of the light emitted from the optical emitter. Accordingly, it is possible to detect potential fraud, for example in the case that a coin sensor at the coin output port 6 does not register a coin being dispensed, when the optical detector 21*a* registers movement of the first sprung finger 10*a*.

The second sprung finger 10*b* has a similar construction to the first sprung finger 10*a*, and comprises an elongate body 14*b*, a coin pushing part 15*b* and a spring coupling part 16*a* for coupling the second sprung finger to a second tension spring 17*b*. The second sprung finger may further include a tab 19*b* for use in conjunction with an optical emitter 20*b* and an optical detector 21*b* to detect movement of the second sprung finger 10*b* in the manner described previously with respect to the first sprung finger 10*a*.

A finger engaging part 18*b* is disposed towards the rear of the elongate body 14*b*. The finger engaging part 18*b* has a rectangular cross-section and extends towards the first sprung finger 10*a* at right angles to the axis of the elongate body 14*b*. The finger engaging part 18*b* of the second sprung finger 10*b* is positioned along the elongate body 14*b* such that it lies directly behind the finger engaging part 18*a* of the first sprung finger 10*a*, when neither sprung fingers 10*a*, 10*b* are biased by a coin.

The operation of the first and second sprung fingers 10*a*, 10*b* will now be described with reference to FIGS. 8*a* to 8*e*.

Figure 8A:
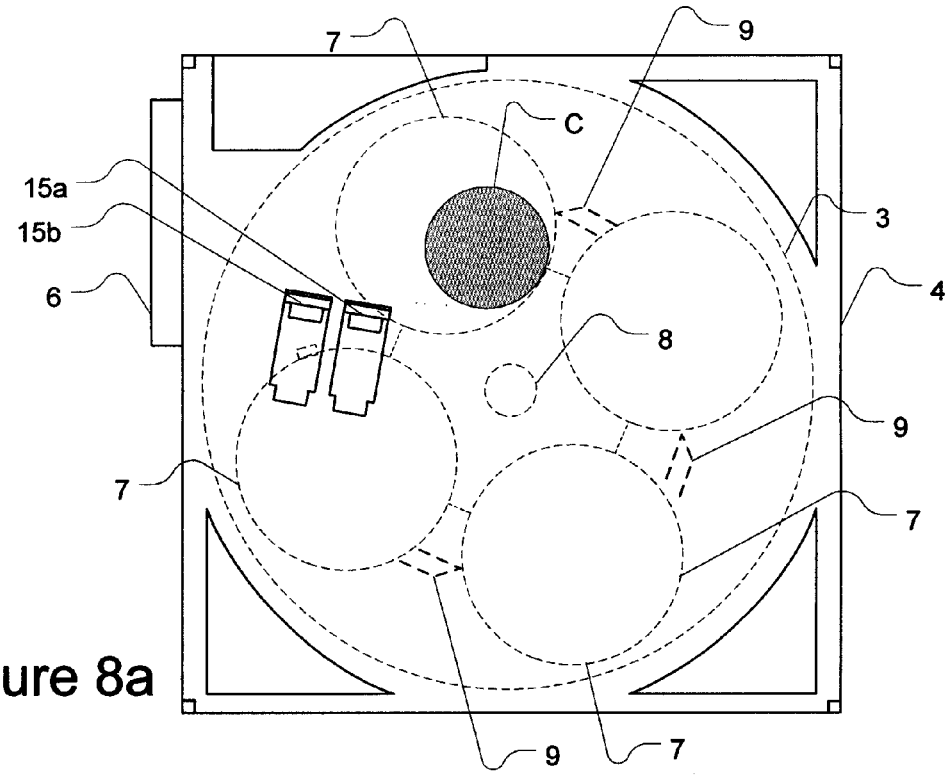
FIGS. 8*a*-8*e* show a coin being dispensed by the action of the sprung fingers of FIGS. 6 and 7 as the rotor rotates.

Referring to FIG. 8*a*, the rotor 3 rotates in an anti-clockwise direction and a coin C in an aperture 7 of the rotor 3 is moved in an annular path across the floor of the hollow 5 towards the first and second sprung fingers 10*a*, 10*b*.

Figure 8B:
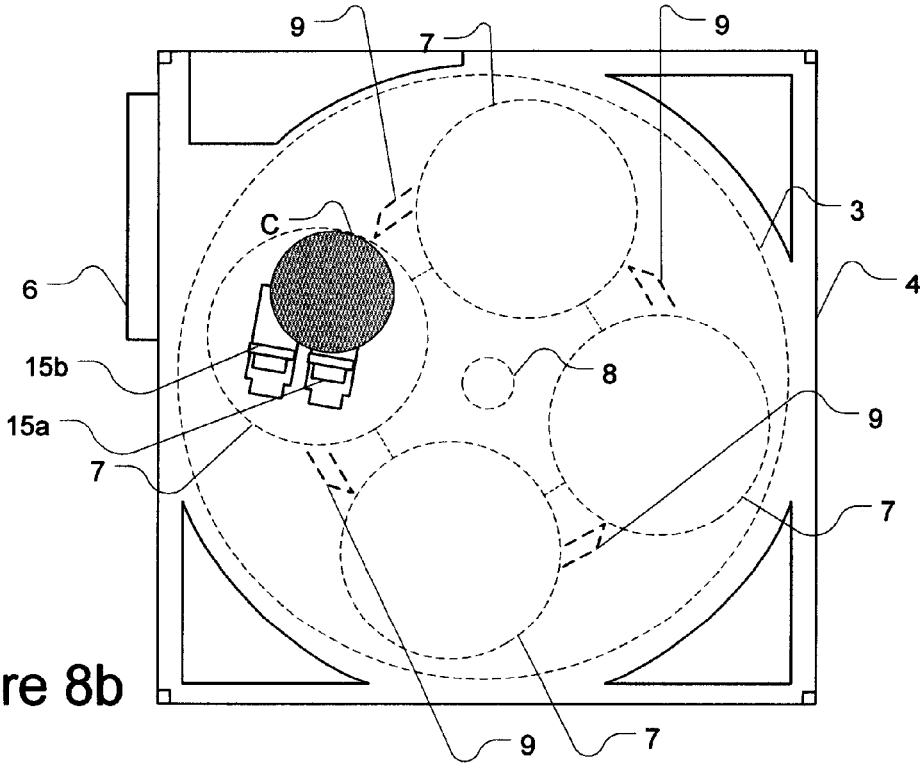

Referring to FIG. 8*b*, when the coin C is driven against the coin pushing part 15*a* of the first sprung finger 10*a*, by the action of the rotor 3 rotating, the first sprung finger 10*a* is forced backwards, causing the finger engaging part 18*a* of the first sprung finger 10*a* to push against the finger engaging part 18*b* of the second sprung finger 18*b*. Accordingly, the second sprung finger 10*b* is pushed backwards, even though the coin pushing part 15*b* of the second sprung finger 10*b* is not in contact with the coin.

Figure 8C:
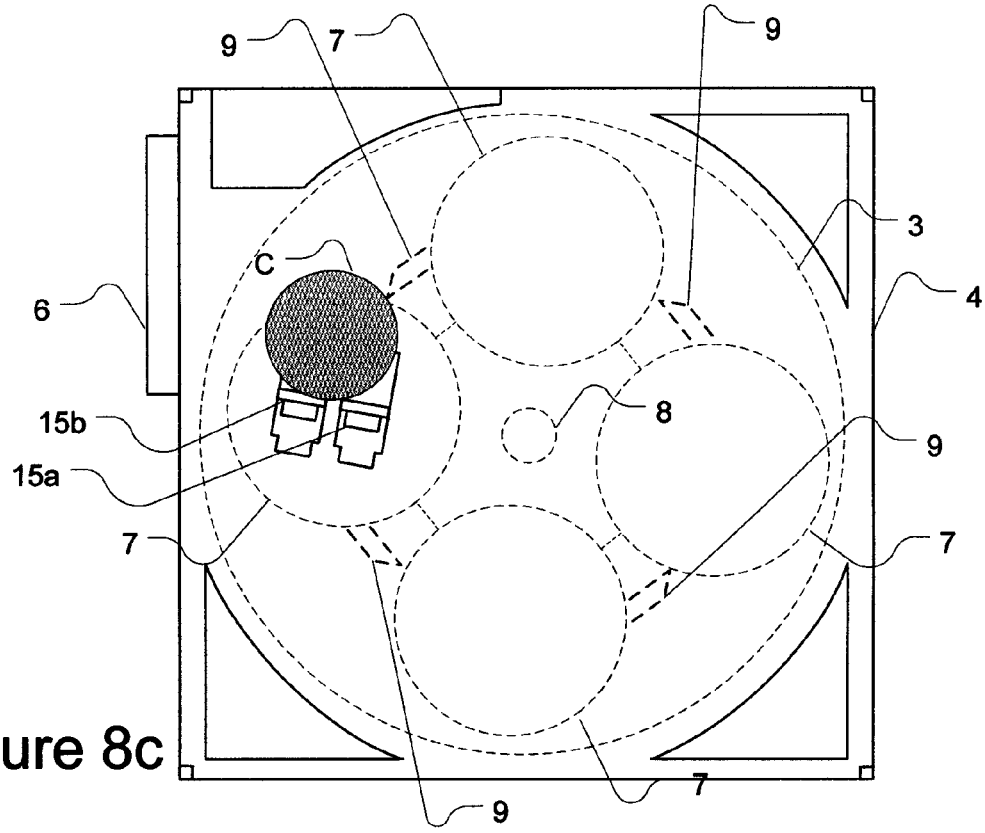

Referring to FIG. 8*c*, as the rotor 3 continues to rotate, the coin C is squeezed between the coin engaging part 9 of the rotor 3 and the coin pushing part 15*a* of the first sprung finger 10*a*. The coin C is squeezed substantially chordally. In the present example, the points of the coin C about which the coin C is squeezed by the engaging part 9 and coin pushing part 15*a* are not diametrically aligned with the circular face of the coin C. In particular, the centre of the chord about which the coin C is squeezed is radially inwards of the centre of the coin C with respect to the rotor 3. Accordingly, a lateral force is provided to the coin C as a result of the coin engaging part 9 and coin pushing part 15*a* sliding against the curved edge of the coin C. This lateral force acts in an outwardly radial direction with respect to the rotor 3 and pushes the coin C towards the coin output port 6. The coin C slides across the coin pushing part 15*a* of the first sprung finger 10*a* and onto the coin pushing part 15*b* of the second sprung finger 10*b*.

Figure 8D:
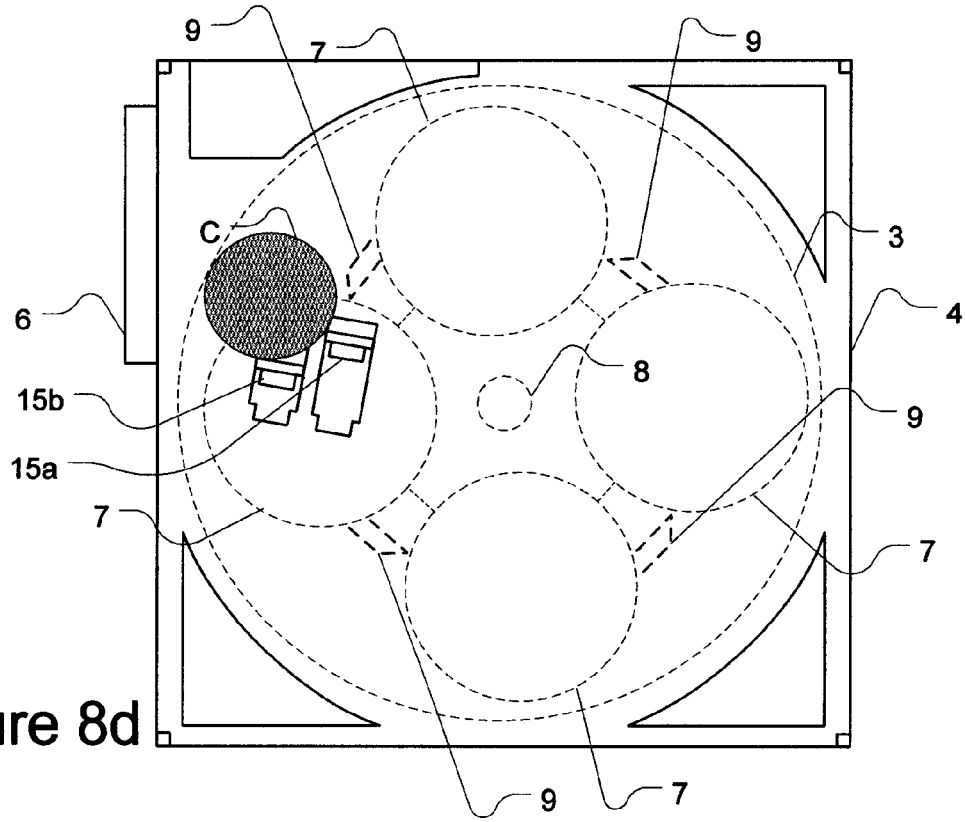

Referring to FIG. 8*d*, as the rotor 3 continues to rotate, the coin C moves away from the first sprung finger 10*a* and the coin engaging part 9 of the rotor 3 is moved such that it no longer biases the coin C against the force exerted by the first and second sprung fingers 10*a*, 10*b* caused by the tension springs 17*a*, 17*b*. Accordingly, the first sprung finger 10*a* springs forward causing the coin pushing part 15*a* of the first sprung finger 10*a* to flick the back edge of the coin C. At the same time, the coin pushing part 15*b* of the second sprung finger 10*b* pushes the coin C towards the coin output port 6. Again, in the present example, the coin pushing part 15*b* of the second sprung finger 10*b* and the coin engaging part 9 together squeeze the coin C substantially chordally. The centre of the chord about which the coin C is squeezed is radially inward of the centre of the coin C with respect to the rotor 3 so as to provide a lateral force acting in an outwardly radial direction with respect to the rotor 3 to push the coin C towards the coin output port 6.

Figure 8E:
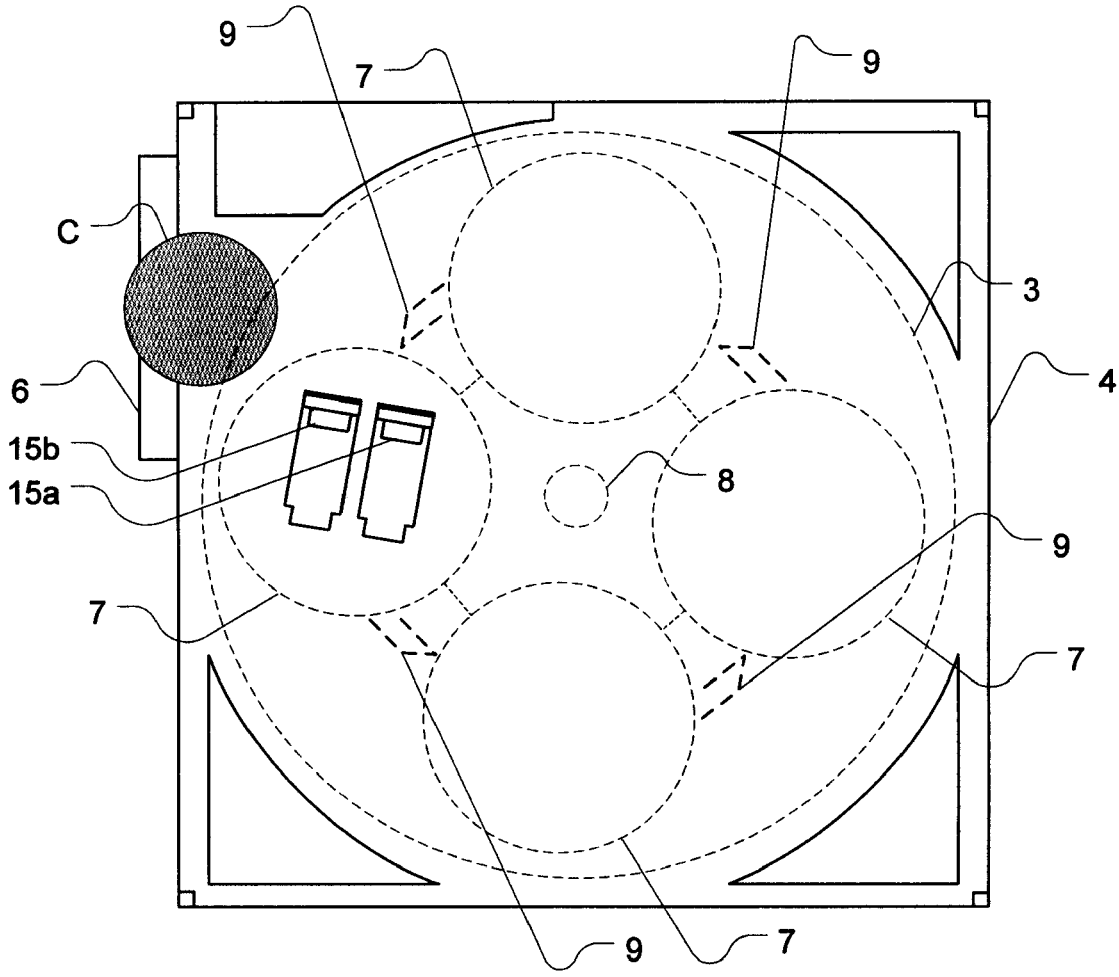

Referring to FIG. 8*e*, the coin C is ejected through the coin output port 6 under the force exerted by the first and second sprung fingers 10*a*, 10*b*. The first and second sprung fingers 10*a*, 10*b* return to their initial positions ready for the next coin to be dispensed.

Figure 9:
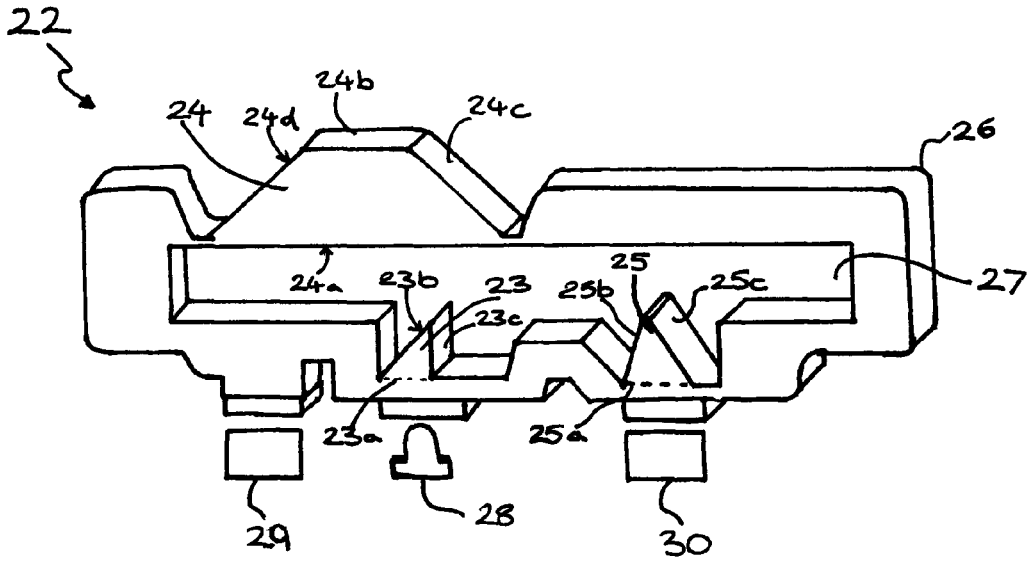
FIG. 9 is a perspective view of the coin sensor of the coin dispensing apparatus of FIG. 1.

The coin sensor will now be described with reference to FIGS. 9, 10 and 11. Referring to FIG. 9, the coin sensor 22 comprises first, second and third prisms 23, 24, 25 arranged at spaced apart locations with respect to one another. In the present example, the first, second and third prisms 23, 24, 25 are formed within a frame 26. The frame is disposed adjacent to the coin output port 6 and defines a generally rectangular aperture 27 through which coins are dispensed along a coin ejection path between the rotor 3 and the coin output port 6.

The coin sensor 22 also comprises an optical emitter device 28 and first and second optical detectors 29, 30, all of which are disposed adjacent to the lower edge of the frame, below the coin ejection. The optical emitter device 28 is orientated so as to emit light in a direction normal to the coin ejection path. The first and second optical detectors 29, 30 are disposed on opposite sides of the optical emitter device 28.

The optical emitter device 28 is, in the present example, arranged to emit a pulsed beam to be detected by the first and second optical detectors 29, 30. The first and second optical detectors 29, 30 can accordingly be configured to be responsive to detection of the pulsed beam rather than a continuous beam. Use of a pulsed beam in this way can provide a further level of security against fraudulent attacks, for instance those attacks in which a fraudster attempts to blind detectors with light. In alternative arrangements, a continuous beam can be used.

The first prism 23 has a right-angled triangular cross-section and comprises first, second and third faces 23*a*, 23*b*, 23*c*. The first face 23*a* is in the plane of the coin ejection path, the second face 23*b* is inclined at 45° to the first face 23*a* and the third face 23*b* extends between the first and second faces 23*a*, 23*b*, at right angles to the first face 23*a*.

The first prism 23 is disposed above the optical emitter device 28, such that a portion of the light emitted by the optical emitter device 28 passes through the first face 23*a*. An approximately equal portion of the light passes beside the first prism 23, parallel to the third face 23*c*.

The second prism 24 has a regular trapezoidal cross-section and comprises first, second, third and fourth faces 24*a*, 24*b*, 24*c*, 24*d*. The first and second faces 24*a*, 24*b* are parallel to each other and to the plane of the coin ejection path. The third and fourth faces 24*c*, 24*d* are inclined at 45° to the first face 24*a* and slope upwards to meet respective ends of the second face 24*b*.

The second prism 24 is disposed above the coin ejection path, such that the third face 24*c* is opposite the region adjacent to the first prism 23 through which light from the optical emitter device 28 passes. Furthermore, the fourth face 24*d* is opposite the first optical detector 29.

The third prism 25 has a generally triangular cross-section and comprises first, second and third faces 25*a*, 25*b*, 25*c*. The first face 25*a* is parallel to the plane of the coin ejection path. The second and third faces 25*b*, 25*c* slope upwards from the first face 25*a*, the second face 25*b* being inclined at a greater angle than the third face 25*c*. The third prism 25 is disposed directly above the second optical detector 30.

The operation of the coin sensor 22 will now be described with reference to FIGS. 10 and 11.

Figure 10:
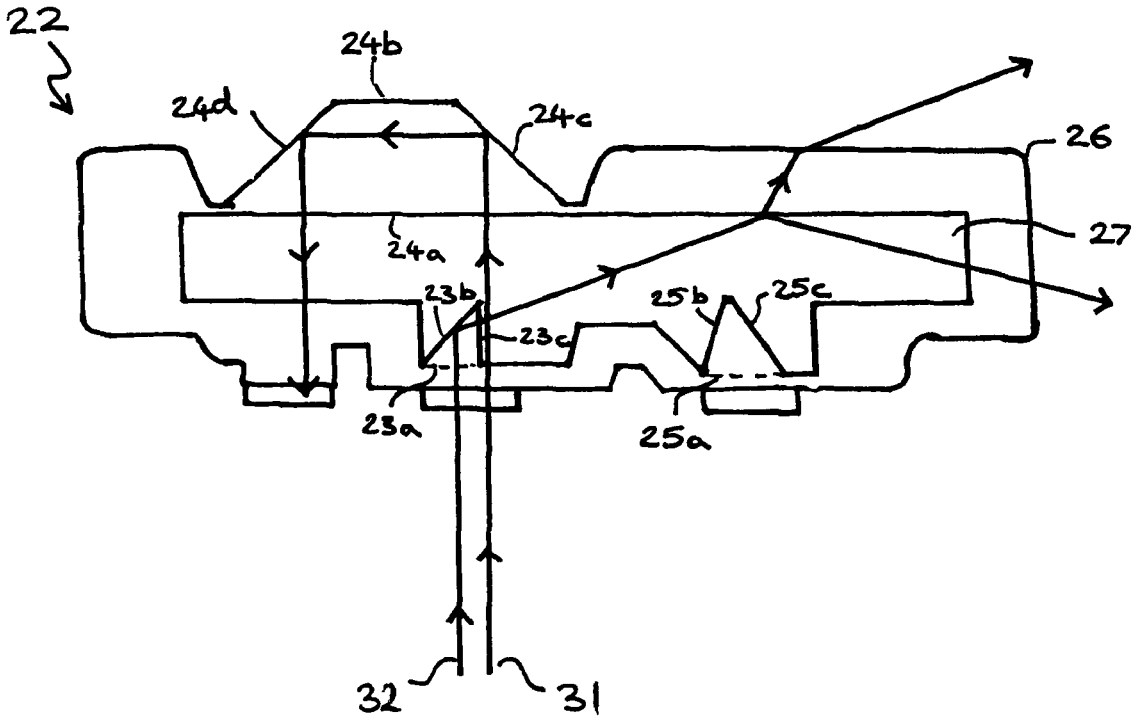
FIG. 10 shows the path of light rays from an optical emitter in the coin sensor of FIG. 9 when no coin is present.

Referring to FIG. 10, the paths of two light rays emitted from the optical emitter device 28 are shown, in the case where no coin is present in the aperture 27.

A first light ray 31 is emitted by the optical emitter device 28 at right-angles to the coin ejection path and passes to the side of the first prism 23. The first light ray 31 crosses the aperture 27 and is incident on the first face 24*a* of the second prism 24 at right-angles. Accordingly, the first ray 31 is not refracted at the first face 24*a* and propagates through the second prism 24.

Thereafter, the first ray 31 is reflected at the third face 24*c* and propagates through the second prism 24 parallel to the first and second faces 24*a*, 24*b*. The first ray 31 is then reflected at the fourth face 24*d*, passes through the first face 24*a* again at right angles, crosses the aperture 27 and is incident on the first optical detector 29.

A second light ray 32, emitted by the optical emitter device 28, passes through the first face 23*a* of the first prism 23. The second ray 32 is reflected at the second face 23*b* and follows an oblique path across the aperture 27.

Thus, when no coin is present in the aperture 27 of the coin sensor 22, the first optical detector 29 outputs a "high" signal in response to receiving the first ray 31 and the second optical detector 30 outputs a "low" signal.

Figure 11:
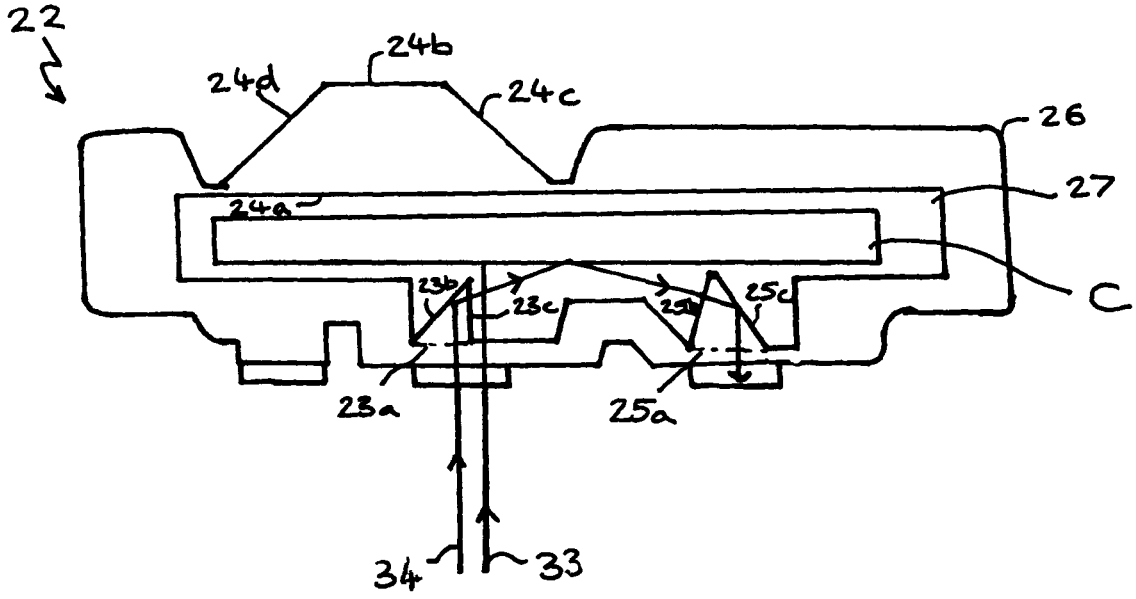
FIG. 11 shows the path of light rays from an optical emitter in the coin sensor of FIG. 9 when a coin is present.

Referring now to FIG. 11, the passage of two light rays emitted from the optical emitter device 28 are shown, in the case where a coin C is present in the aperture 27.

A first light ray 33 is emitted by the optical emitter device 28 at right-angles to the coin ejection path and passes to the side of the first prism 23. The first light ray 33 crosses the aperture 27 and is incident on the coin C.

A second light ray 34, emitted by the optical emitter device 28, passes through the first face 23*a* of the first prism 23. The second ray 34 is reflected at the second face 23*b* and follows an oblique path across the aperture 27.

The second ray 34 is reflected by the coin C and is directed towards the third prism 25. Thereafter, the second ray is refracted at the second face 25*b* of the third prism 25 and reflected at the third face 25*c* toward the first face 25*a*. The second ray 34 passes through the first face 25*a* and is incident on the second optical detector 30.

Thus, when a coin C is present in the aperture 27 of the coin sensor 22, the first optical detector 29 outputs a "low" signal and the second optical detector 30 outputs a "high" signal in response to receiving the second ray 34.

Figure 12:
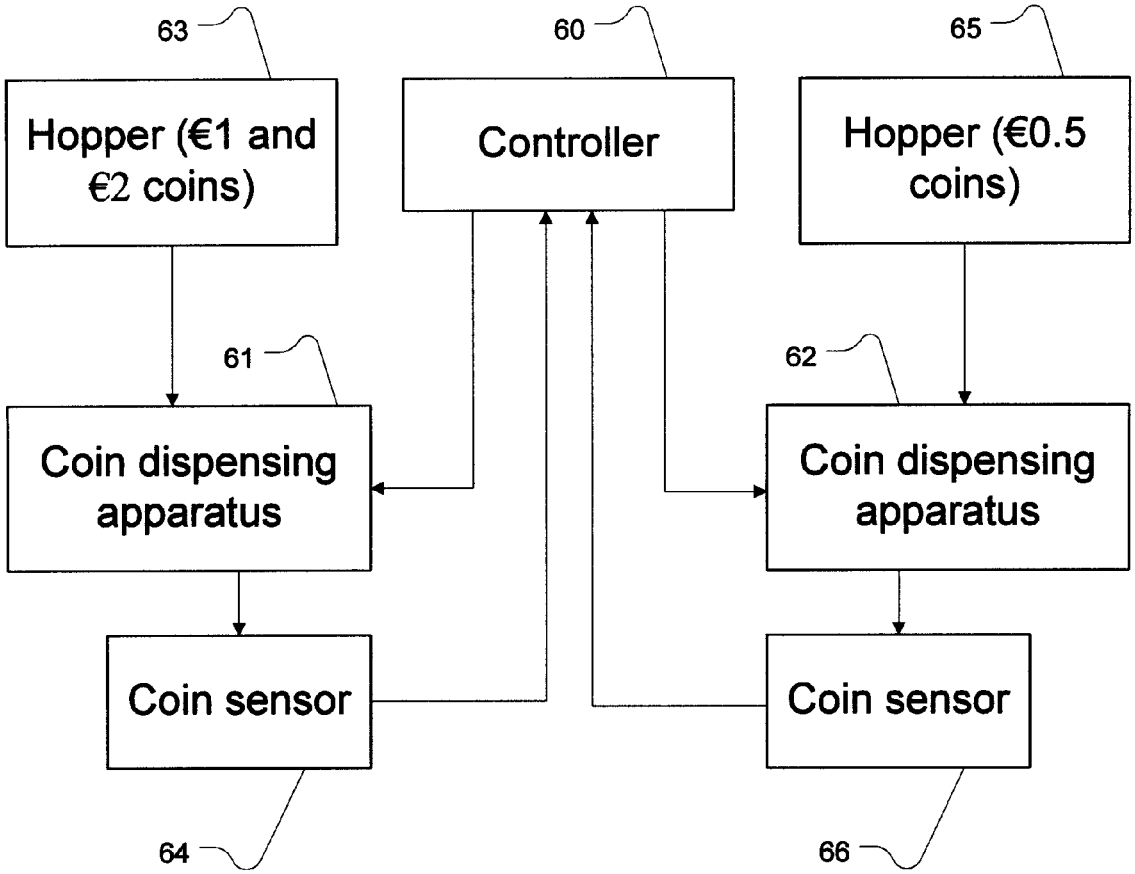
FIG. 12 shows a coin dispensing system including a coin dispensing apparatus according to the present invention.

Referring to FIG. 12, the coin dispensing system comprises a controller 60, such as a microprocessor and first and second coin dispensing apparatuses 61, 62. In the example shown in FIG. 12, the first coin dispensing apparatus 61 is a discriminating re-circulating apparatus, which is fed by a first hopper 63 filled with coins having a number of different denominations. More specifically, the first hopper 63 contains €1 and €2 coins. The first coin dispensing apparatus 61 is provided with a first coin sensor 64 for determining the monetary value of a dispensed coin.

The second coin dispensing apparatus 62 may be an apparatus such as that described above with reference to FIGS. 1 to 11. The second coin dispensing apparatus 62 is fed by a second hopper 65, which contains coins having a single denomination. More specifically, the second hopper 65 contains 50 cent coins. The second coin dispensing apparatus 62 is provided with a second coin sensor 66 for determining whether or not a coin has been dispensed when the rotor 3 is driven.

Figure 13:
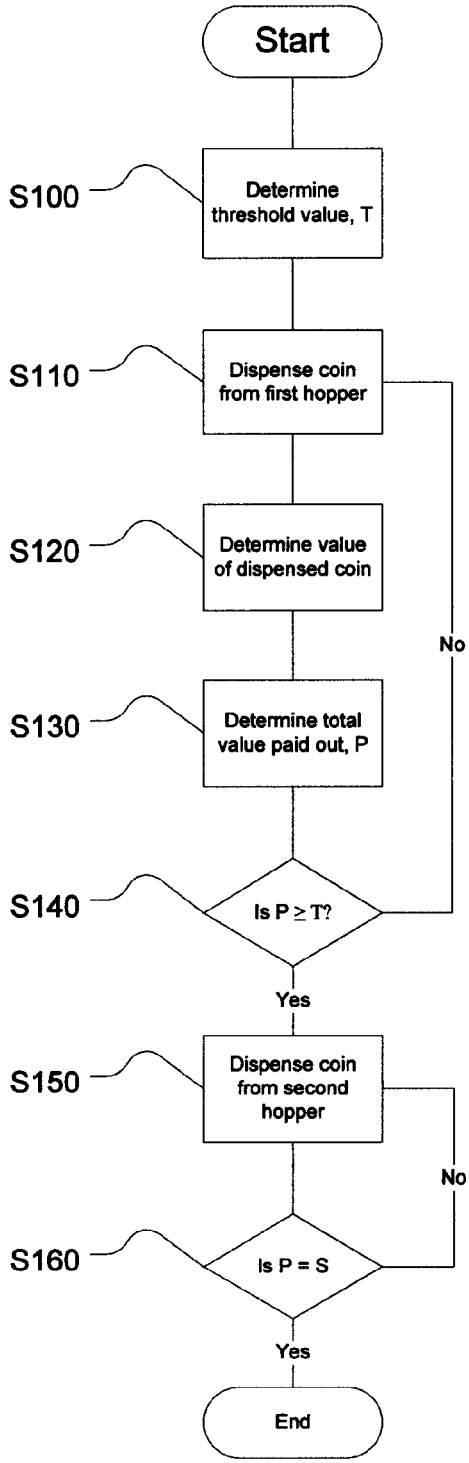
FIG. 13 is a flowchart for explaining the method of operation of the coin dispensing system of FIG. 12.

Referring to FIG. 13, the process of dispensing €12.50 will now be explained.

Firstly, in step S100, the controller 60 calculates a threshold payout value T, for the first coin dispensing apparatus 61. The threshold value T, is determined by the following equation 1;

$$T=S-C_{Max} \quad (1)$$

where S is the total sum of money that is required to be dispensed and $C_{Max}$ is the denomination of the highest value coin which the first hopper 63 is used to store. In the present case, the threshold payout value for the first coin dispensing apparatus 61, T is €10.50 (i.e. €12.50–€2).

Next, in step S110 the controller 60 sends a coin dispense signal to the first coin dispensing apparatus 61 and, accordingly, the first coin dispensing apparatus 61 dispenses a coin from the first hopper 63.

In step S120, the first coin sensor 64 determines the value of the coin dispensed in step S110 and outputs a signal to the controller 60 indicating the value of the coin dispensed.

In step S130, the controller 60 uses the signal output from the first coin sensor 64 in step S120 to calculate the total amount of money paid out, P.

In step S140, the controller 60 compares the total amount of money paid out, P, with the payout threshold value T determined in step S100. When it is determined, in step S140, that P is less than T, steps S110 to S140 are repeated. When it is determined, in step S140, that P is greater than or equal to T, step S150 is performed.

In step S150, the controller 60 outputs a coin dispense signal to the second coin dispensing apparatus 62. Accordingly, in Step S150, the second coin dispensing apparatus 62 dispenses a coin from the second hopper 65.

Since the second hopper 62 only contains coins having a single denomination (50 cent coins), it is not necessary for the coin sensor 66 of the second coin dispensing apparatus 62 to determine the denomination of the coin dispensed. The second coin sensor 66 is merely required to determine whether or not a coin from the second hopper 65 is actually dispensed when the rotor 3 of the second coin dispensing apparatus 62 rotates.

Next, in step S160, the controller 60 re-calculates the total amount of money paid out, P and determines whether or not this is equal to the required sum S. When it is determined that P is not equal to S, steps S150 and S160 are repeated. When it is determined that P is equal to S, the coin dispensing process ends.

Of course, if the first dispensing apparatus 61 becomes empty before the threshold T is reached, the second dispensing apparatus 62 will take over, even though the threshold has not been reached.

There may be a plurality of hoppers holding respective non-overlapping sets of relatively high value coins, e.g. hopper 1 containing 50 p, £1 and £2 coins and hopper 2 containing 20 p and 10 p coins, and one hopper containing low value coins, e.g. hopper 3 containing 5 p coins. In this configuration, an initial threshold T1 is calculated using the maximum value coins in hopper 1, i.e. £2. When the paid out amount reaches or exceeds the first threshold, a second threshold T2 is calculated by subtracting the maximum coin value in the second hopper, i.e. 20 p, from the balance of the payout amount. Then, when the second threshold is reached, the balance is paid out from hopper 3.

In this way, the correct amount can be reliably dispensed.

The invention claimed is:

1. An optical sensor for detecting the passage of a coin through an aperture comprising:

a light source configured to produce a plurality of light beams;

a first detector configured for detecting a first of said beams crossing a coin path in the absence of a coin; and a second detector configured for detecting a second of said beams reflected from a face of a coin in said coin path, wherein said light source is arranged so that when a coin is present in the aperture the first detector outputs a "low" signal and the second detector outputs a "high" signal and so that when a coin in not present in the aperture the first detector outputs a "high" signal and the second detector outputs a "low" signal.

2. An optical sensor according to claim 1, including a light source prism arranged such that some light from the light source enters the light source prism and is directed thereby obliquely across the coin path, for detection by the second detector, and some light from the light source passes by the light source prism and passes substantially perpendicularly across the coin path, for detection by the first detector.

3. An optical sensor according to claim 2, including a light detector prism configured to receive light from the light source prism, that has subsequently been reflected by a coin the coin path, and redirect the received light substantially perpendicular to the light path onto the second detector.

4. An optical sensor according to claim 2, including a trapezoidal prism for returning light, which by-passes the light source prism, back across the coin path to the first detector.

5. An optical sensor according to claim 1, including a member through which the coin path passes, wherein the member comprises a first prism partially aligned with a light source for redirecting some light from the light source obliquely into the coin path, a second prism for capturing light from the first prism and reflected from a coin in the coin path and redirecting the captured light onto the second detector, and a third prism for returning light from the light source, which has not been redirected by the first prism, back across the coin path to the first detector.

6. An optical sensor according to claim 5, wherein the light source and the light detectors are mounted to the member such that the light source is between the light detectors.

7. An optical sensor according to claim 1, wherein the first beam is a pulsed beam.

8. An optical sensor according to claim 1, wherein the second beam is a pulsed beam.

9. An optical sensor according to claim 1, further comprising a processor operable to receive a detection indicating signal from each of the first and second detectors.

10. An optical sensor according to claim 9, wherein the processor is further operable to provide an output signal, in response to the detection indicating signals, indicative of the detection of the passage of a coin.

11. A coin dispensing apparatus including an optical sensor according to claim 1 for detecting coins being dispensed.

12. A coin dispensing apparatus for ejecting coins by squeezing them substantially chordally between first and second elements, the second element being carried on the underside of a rotor which rotates, over a surface, with a central shaft, wherein the rotor can be mounted to the shaft a plurality of configurations to set the distance between the rotor and said surface differently, the apparatus further comprising an optical sensor according to claim 1 for detecting coins being dispensed.

13. A coin dispensing apparatus for ejecting coins by squeezing them substantially chordally between first and second elements, the second element being carried on the underside of a rotor, which rotates over a surface, and the first element comprising a first, radially inner ejector and a second, radially outer ejector, wherein the ejectors are configured such that the first ejector can move in a coin ejecting direction without the second ejector also moving in its coin ejecting direction, the apparatus further comprising an optical sensor according to claim 1 for detecting coins being dispensed.

14. An optical sensor for detecting the passage of a coin comprising:

a first detection device for producing and detecting a first beam crossing a coin path in the absence of a coin, and a second detection device for producing and detecting a second beam reflected from a coin in said coin path, wherein the first and second detection devices share a light source and employ respective optical detectors; and a light source prism arranged so that some light from the light source enters the light source prism and is directed thereby obliquely across the coin path, for use in the second detection device, and some light from the light source passes by the light source prism and passes substantially perpendicularly across the coin path, for use in the first detection device.

15. An optical sensor according to claim 14, including a light detector prism configured to receive light from the light source prism, that has subsequently been reflected by a coin in the coin path, and redirect the received light substantially perpendicularly to the light path onto the optical detector of the second detection device.

16. An optical sensor according to claim 14, including a trapezoidal prism for returning light, which by-passes the light source prism, back across the coin path to the optical detector of the first detection device.

17. An optical sensor for detecting the passage of a coin comprising:

a first detection device for producing and detecting a first beam crossing a coin path in the absence of a coin;

a second detection device for producing and detecting a second beam reflected from a coin in said coin path;

a member through which the coin path passes, wherein the member comprises a first prism partially aligned with a light source for redirecting some light from the light source obliquely into the coin path, a second prism for capturing light from the first prism and reflected from a coin in the coin path and redirecting the captured light onto a first light detector, and a third prism for returning light from the light source, which has not been redirected by the first prism, back across the coin path to a second light detector.

18. An optical sensor according to claim 17, wherein the light source and the light detectors are mounted to the member such that the light source is between the light detectors.

* * * * *

UNITED STATES PATENT AND TRADEMARK OFFICE

CERTIFICATE OF CORRECTION

PATENT NO. : 7,987,961 B2
APPLICATION NO. : 12/089701
DATED : August 2, 2011
INVENTOR(S) : Malcolm Reginald Hallas Bell et al.

It is certified that error appears in the above-identified patent and that said Letters Patent is hereby corrected as shown below:

IN THE CLAIMS

Column 10, line 58, claim 1, please delete the first occurrence of the word "in", and insert the word --is--.

Column 11, line 40, claim 12, after the second occurrence of the word "shaft", please insert the word --in--.

Signed and Sealed this
Third Day of January, 2012

David J. Kappos

David J. Kappos
*Director of the United States Patent and Trademark Office*